United States Patent [19]

Sykes

[11] Patent Number: 4,655,366

[45] Date of Patent: Apr. 7, 1987

[54] REINFORCED CONTAINER AND METHOD OF MAKING

[75] Inventor: Harry P. Sykes, Maple Glen, Pa.

[73] Assignee: Walnut Industries, Inc., Bensalem, Pa.

[21] Appl. No.: 871,370

[22] Filed: Jun. 6, 1986

Related U.S. Application Data

[63] Continuation-in-part of Ser. No. 736,242, May 20, 1985, abandoned.

[51] Int. Cl.[4] ..... B65D 6/34

[52] U.S. Cl. ..... 220/441; 220/71; 229/23 R; 229/48 R; 229/199; 493/89; 493/383; 493/908

[58] Field of Search ..... 220/71, 414, 441, 449, 220/1 B, 455, 461, 462, 468; 229/23 R, 48 R, 199; 138/174, DIG. 2; 493/89, 115, 379, 383, 386, 394, 908

[56] References Cited

U.S. PATENT DOCUMENTS

| | | | |
|---|---|---|---|
| 1,282,862 | 10/1918 | Knox | 220/71 |
| 2,091,291 | 8/1937 | Ringler | 229/37 R |
| 2,718,583 | 9/1955 | Noland et al. | 138/DIG. 2 |
| 3,002,534 | 10/1961 | Noland | 138/DIG. 2 |
| 3,257,063 | 6/1966 | Oliver | 220/441 |
| 3,501,047 | 3/1970 | Raabe | 220/71 |
| 3,653,578 | 4/1972 | Wood | 229/23 R |
| 3,947,305 | 3/1976 | Leroux et al. | 156/62.4 |
| 3,956,816 | 5/1976 | Short | 220/1 B |
| 3,990,600 | 11/1976 | Rossitto et al. | 220/1 B |
| 4,023,700 | 5/1977 | Buquet et al. | 220/71 |
| 4,392,606 | 7/1983 | Fremion | 229/23 R |
| 4,492,065 | 1/1985 | Clark, Jr. et al. | 52/595 |

FOREIGN PATENT DOCUMENTS

| | | | |
|---|---|---|---|
| 581899 | 8/1959 | Canada | 220/441 |

OTHER PUBLICATIONS

Handbook of Corrugated Fibreboard Boxes & Products, Fibre Box Association, 1968, p. 31.

*Primary Examiner*—William Price
*Assistant Examiner*—Gary E. Elkins
*Attorney, Agent, or Firm*—Walter B. Udell

[57] ABSTRACT

Reinforced corrugated cartons on the order of 35 to 50 inches in height and somewhat greater in length and width are provided with an inside tubular rectangular liner and a bottom pad fitted down inside the liner and adhesively secured to the inside bottom flaps of the carton. Disposed entirely peripherally around the carton sidewalls or the tubular liner and extending upward for a distance from substantially the bottom thereof on the outside is a belt of non-woven backing material with yarns laminated thereon and extending peripherally laterally completely therearound. The yarns may be of any material which exhibits minimal elongation under tension. The belt backing material may typically be of non-woven polyester and approximately 20" or so in width extending upward from substantially the bottom of the carton or liner, and the yarns may typically each be 1800 denier formed of approximately 250 fiberglass filaments and arranged with a side by side density of 20 to the inch at the bottom reducing to 5 to the inch at the top and graded in between. The belt is wrapped around the carton or liner with the backing material thereagainst and held thereto with several glue spots with the ends of the belt brought into abutment on the surface of the carton or liner. A patch of the same material is then glued firmly over the butt joint with the filaments of the patch facing and adhered to the filaments of the belt.

19 Claims, 8 Drawing Figures

FIG. 3
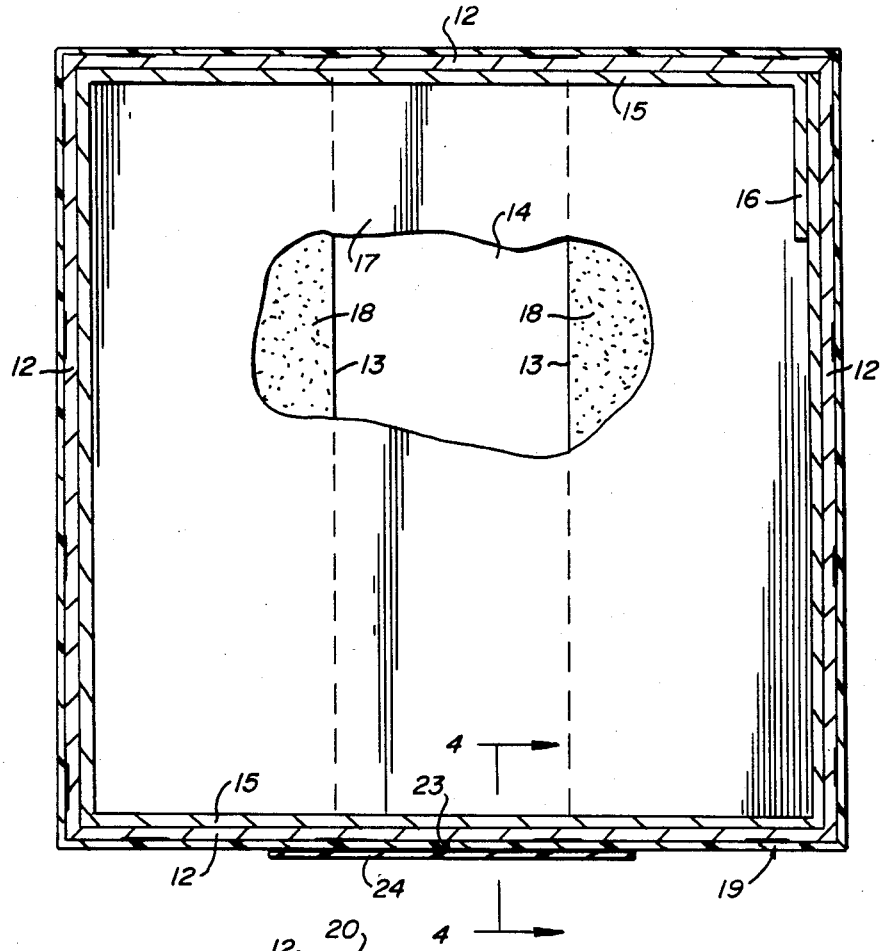
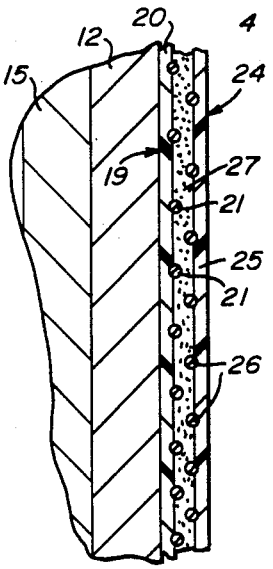
FIG. 4
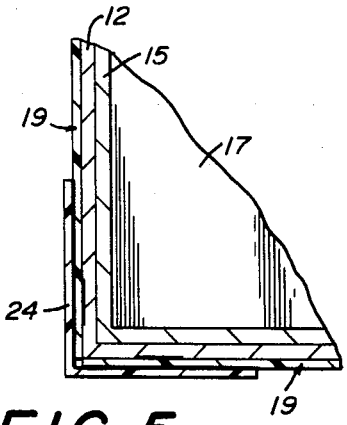
FIG. 5

REINFORCED CONTAINER AND METHOD OF MAKING

This invention relates generally to corrugated containers, and more particularly relates to such containers for holding flowable granulated materials and flowable gelatinous substances, this application being a continuation-in-part of copending application Ser. No. 736,242 filed May 20, 1985 now abandoned and assigned to the assignee of this application. The granulated materials flow almost like fluids, and the gelatinous substances have substantial rates of cold flow, some of these materials being of relatively high density.

Containers for such products are usually made in sizes of several feet on each dimension, and when holding materials of the nature described can weigh hundreds of pounds. Typically, such containers may be made from 600 lb. test double wall corrugated material or 1100 lb. test triple wall corrugated material. Even such heavy duty containers when filled with the flowable materials and stacked two to four containers high for shipment are not immune from bulging of the container walls in the bottom units, with the attendant potential of container rupture or column failure which causes the upper boxes to topple over. Consequently, it has been necessary in the past to either compartmentalize such containers as load distributing structures, or to enclose such containers in wooden frames to provide wall support therefor.

The novel containers according to the invention not only eliminate the necessity for using wooden frames or compartmentalizing the containers, but also permit reduction in the necessary strength of the container wall structures from the previously mentioned types to container walls made of approximately 350 lb. test double wall corrugated material. These changes effect a substantial cost reduction in the containers used for these applications.

Briefly, as will be subsequently described in connection with the drawings appended hereto, the corrugated cartons may be on the order of 35 to 50 inches in height and somewhat greater in length and width, and are provided with an inside tubular rectangular liner and a two ply bottom pad fitted down inside the liner and adhesively secured to the inside bottom flaps of the carton. In one form of the invention there is disposed entirely peripherally around the outside of the carton sidewalls and extending upward for a distance from substantially the bottom thereof a belt of non-woven backing material with yarns laminated thereon and extending peripherally laterally completely around the carton. The belt yarns may be of any material which exhibits minimal elongation under tension. In another form of the invention the belt is disposed around the tubular liner which as a unit fits within the carton.

The belt backing material may typically be of non-woven polyester and approximately 20" or so in width extending upward from substantially the bottom of the carton or liner, and the yarns may typically each be 1800 denier formed of approximately 250 fiberglass filaments and arranged with a side by side density of 20 to the inch at the bottom reducing to 5 to the inch at the top and graded in between. The belt is wrapped around the carton or liner with the backing material against the carton or liner and held thereto with several glue spots, with the ends of the belt brought into abutment on the surface of the carton. A patch of the same material is then glued firmly over the butt joint with the filaments of the patch facing and adhered to the filaments of the belt.

It is a primary object of the invention to provide a novel reinforced corrugated container for safely holding flowable granulated materials and flowable gelatinous substances of relatively high density utilizing thinner than normal container walls and eliminating compartmentalization within the carton or wooden external structural framing as supplementary carton support structures.

Another object of the invention is to provide a novel reinforced container as aforesaid in which the corrugated carton or interior tubular liner is provided with a retaining belt extending entirely peripherally thereabout and upward for a distance from the bottom of the carton or liner.

Yet another object of the invention is to provide a novel reinforced container as aforesaid wherein the reinforcing belt structure is made of a non-woven backing material with parallel disposed yarns laminated thereon and extending lengthwise of the belt structure, the belt being secured to the carton or interior tubular liner to thereby dimensionally stabilize the carton.

A further object of the invention is to provide a method of making the aforedescribed reinforced containers.

The foregoing and other objects of the invention will become clear from a reading of the following specification in conjunction with an examination of the appended drawings, wherein:

FIG. 3 is a horizontal sectional view through the novel carton according to the invention as would be seen when viewed along the line 3—3 on FIG. 2, and also disclosing a partially removed section of the bottom structure to disclose the underlying configuration;

FIG. 4 is a fragmentary enlarged section through the wall of the reinforced container according to the invention as would be seen when viewed along the line 4—4 on FIG. 3;

FIG. 5 is an enlarged fragmentary corner detail of an alternate way of applying the locking patch to the reinforcing belt at the corner instead of on the face of a carton panel;

In the several figures, like elements are denoted by like reference characters.

Figure 1:
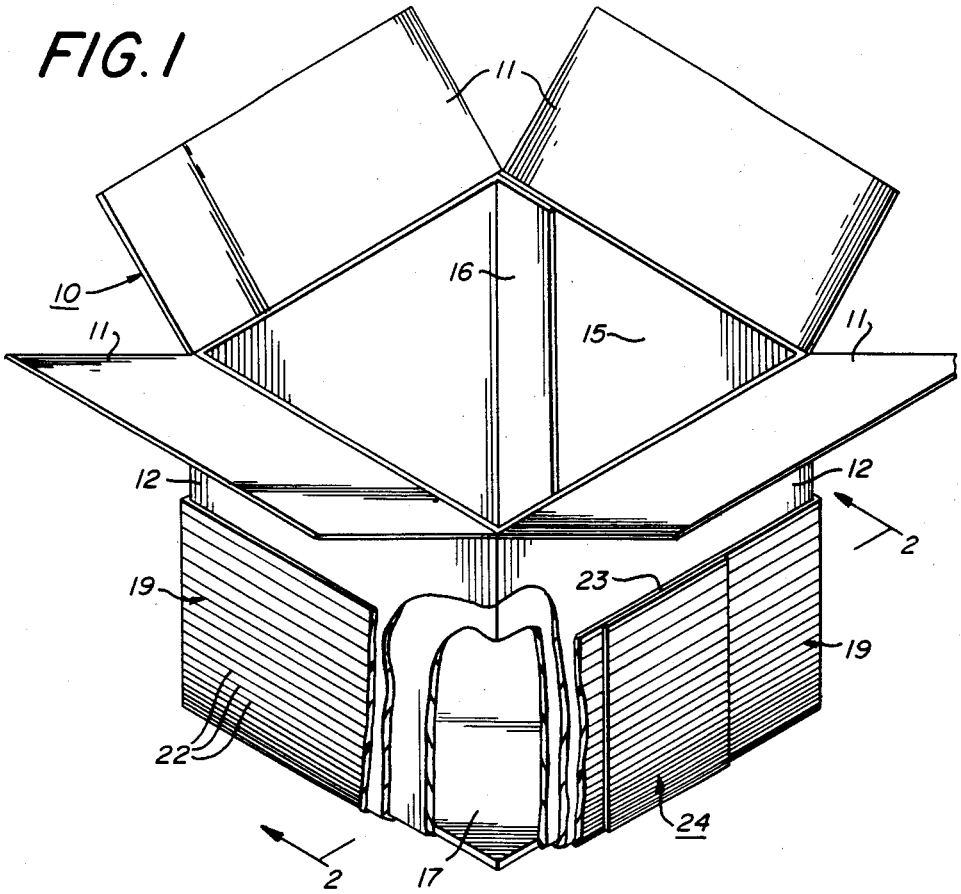
FIG. 1 is an isometric view of a reinforced container according to the invention with the top flaps open and with a portion of a lower corner structure being sectioned away to disclose underlying details.
Figure 2:
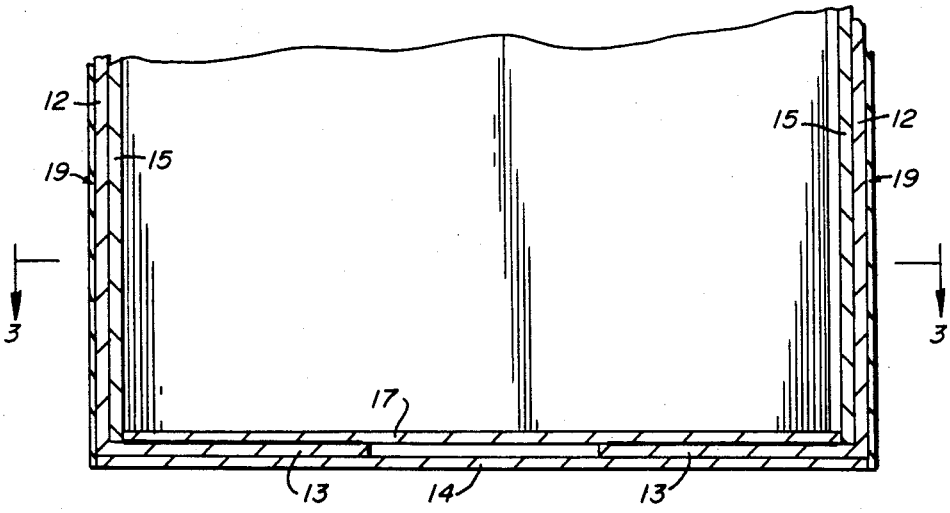
FIG. 2 is an enlarged fragmentary section taken through the carton of FIG. 1 as would be seen along the line 2—2 on FIG. 1.

Referring now to the drawings and first to FIGS. 1 to 4, there is seen a carton referred to generally as 10 having the usual top flaps 11, sidewalls 12, interior bottom flaps 13 and exterior bottom flaps 14, the carton being formed in the normal and usual structural fashion for such corrugated cartons. Disposed vertically within the carton is a rectangular liner tube 15 having its ends lapped at one corner by the flap 16. Disposed within the confines of the liner tube 15 and placed flatwise downward upon the interior bottom flaps 13 is a bottom pad 17 adhered to the upper surfaces of the interior bottom flaps 13 by adhesive 18.

Wrapped peripherally about the walls of the carton 10 for a distance extending upward from the bottom edge of the carton is a reinforcing belt 19 made of a non-woven backing material 20 which typically could be polyester, to which is adhered a plurality of side by side yarns 21 extending longitudinally of the length of the reinforcing belt and spaced laterally in a varying density arrangement as shown by the lines 22, the yarns being closely spaced at the bottom edge of the belt and gradually becoming wider in spacing towards the top of the belt. The yarns and their spacings typically could be 1800 denier yarns formed of 250 fiberglass filaments each at a density of 20 to the inch at the bottom edge of the belt reducing to 5 to the inch at the upper edge of the belt and graded therebetween.

As best seen in FIGS. 1 and 3, the ends of the reinforcing belts are abutted on one face of the carton as shown at 23, and a locking patch 24 is adhesively secured across the abutment line 23 to fixedly secure the ends of the reinforcing belt together and prevent their being separated under stress from the load within the carton. The path 24 is shown with gradation lines in FIG. 1, but it is to be understood that these gradation lines represent yarns on the inner face of the patch and not on the outer face. This is more clearly shown in FIG. 4 where the patch is shown to be of the same structure as the belt and includes a non-woven backing portion 25 and an array of yarns 26. As also shown in FIG. 4, the yarns and backing of the patch 24 are adhered to the yarns and backing of the reinforcing belt 19 by adhesive 27, with the yarns 21 and 26 facing one another. As shown in FIG. 4, the yarns do not appear to be in contact with each other, and this could occur in the relatively widely spaced upper regions of the belt, but toward the lower regions of the belt where the density is much higher, the yarns 21 and 26 will e in close proximity or substantial engagement with one another at their points of adherence.

An alternative locking patch configuration, and a preferred one, is shown in the detail of FIG. 5 which differs only from the structure shown in the other figures in that the ends of the reinforcing belt 19 are abutted at a corner of the carton instead of on a face of the carton, and the patch 24 is applied around the corner of the carton, all as shown in FIG. 5.

Figure 6:
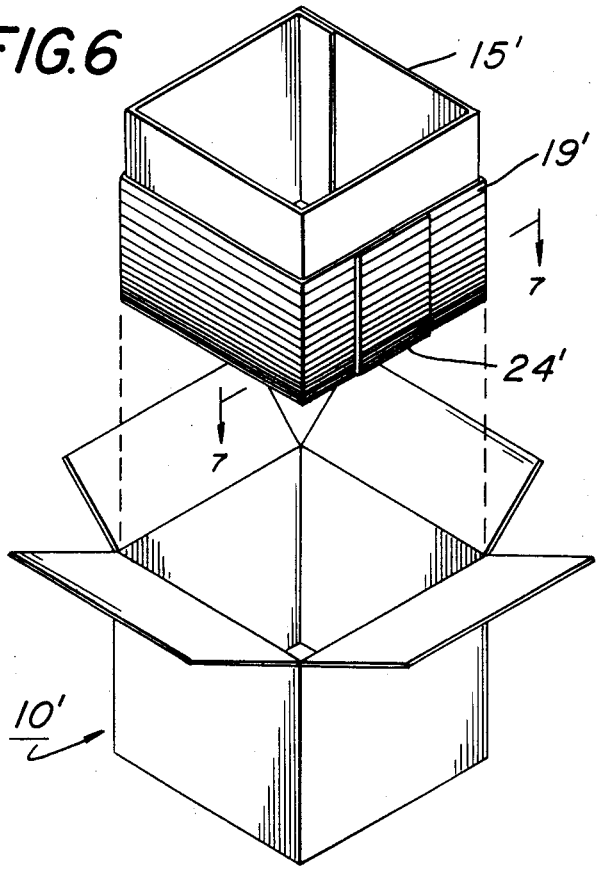
FIG. 6 is an isometric exploded view of another form of reinforced container according to the invention in which the container liner is reinforced instead of the outer carton.
Figure 8:
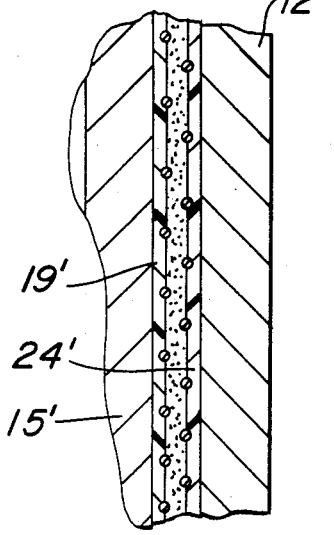
FIG. 8 is a fragmentary enlarged section through the container wall as would be seen when viewed along lines 8—8 on FIG. 7.
Figure 7:
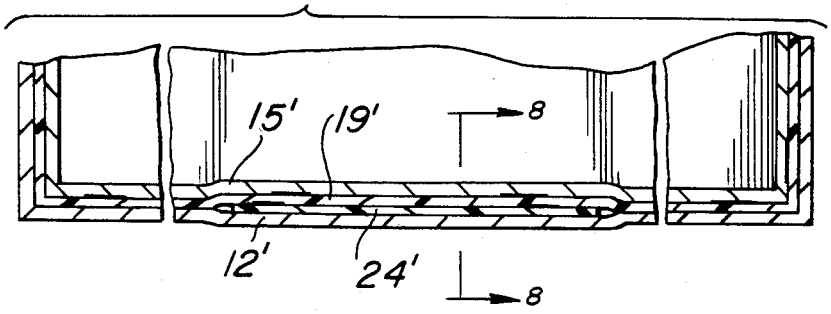
FIG. 7 is an enlarged fragmentary view through the container structure of FIG. 6 as would be seen when viewed along lines 7—7 on FIG. 6.

Considering now FIGS. 6 to 8 there is seen a carton 10' having sidewalls 12' and a tubular liner 15' as in FIGS. 1 through 5, but wherein the reinforcing belt 19' with its locking path 24' is disposed about and adhesively tacked to the periphery of the liner 15' instead of about the outer lower periphery of the carton 10'. This to some degree protects the reinforcing belt.

Having now described the invention in connection with particularly illustrated embodiments thereof, modifications and variations of the invention may naturally occur from time to time to those persons normally skilled in the art without departing from the essential scope or spirit of the invention, and accordingly it is intended to claim the same broadly as well as specifically as indicated by the appended claims.

What is claimed is:

1. A high strength reinforced container comprising in combination, (a) a corrugated carton having sidewalls, a top closure and a bottom closure, (b) a wide reinforcing belt having a pair of side edges and a pair of opposite ends, said belt being disposed entirely peripherally around the carton sidewalls and secured thereto, said belt extending upward for a distance from substantially the bottom of said carton, and said belt comprising a nonwoven backing material to which is adhered a parallel array of yarns extending lengthwise of said belt, said yarns being of a type which exhibits minimal elongation under tension, securing means securing the said opposite ends of said belt against relative movement in belt loosening directions and wherein said securing means comprises a patch made of the same material as said belt, said patch having upper and lower side edges and being adhesively secured to said belt with the yarns of the patch and belt being disposed in facing relation and sandwiched between the backing material of said belt and patch.

2. A container as set forth in claim 1 further including a tubular rectangular liner disposed within said container in flatwise surface engagement with the inside surfaces of said container sidewalls, and a bottom pad fitted inside said liner and adhered to the inside surface of said container bottom closure.

3. A container as set forth in claim 1 wherein the said opposite ends of said belt are disposed in substantial abutment on a flat sidewall surface of said container, and said securing means comprises a patch adhered flatwise to said belt on opposite sides of said abutment and disposed on said flat sidewall surface of said container.

4. A container as set forth in claim 1 wherein at least two adjacent portions of said sidewalls meet along a vertically extending line, wherein the said opposite ends of said belt substantially meet from opposite directions at said vertically extending line, and said securing means comprises a patch adhered flatwise to said belt and overlapping the ends thereof on opposite sides of said vertically extending line.

5. A container as set forth in claim 1 wherein said belt is substantially one half to two thirds the height of said container.

6. A container as set forth in claim 1 wherein the width of said patch between its upper and lower side edges is substantially the same as the width of said belt between its side edges.

7. A container as set forth in claim 1 wherein said yarns are spaced closely together in parallel array at the edge of said belt nearest the container bottom, are relatively widely spaced at the upper edge of said belt, and are continuously graded in spacing density between the two edges of said belt.

8. A container as set forth in claim 7 wherein said belt is substantially one half to two thirds the height of said container.

9. A container as set forth in claim 7 wherein the width of said patch between its upper and lower side edges is substantially the same as the width of said belt between its side edges.

10. A container as set forth in claim 7 wherein the said opposite ends of said belt are disposed in substantial abutment on a flat sidewall surface of said container, and said securing means comprises a patch adhered flatwise to said belt on opposite sides of said abutment and disposed on said flat sidewall surface of said container.

11. A container as set forth in claim 7 wherein at least two adjacent portions of said sidewalls meet along a vertically extending line, wherein the said opposite ends of said belt substantially meet from opposite directions at said vertically extending line, and said securing means comprises a patch adhered flatwise to said belt and overlapping the ends thereof on opposite sides of said vertically extending line.

12. A container as set forth in claim 7 wherein said belt non-woven backing is made of polyester material and said yarns are made of fiberglass.

13. A high strength reinforced container comprising in combination, (a) a corrugated carton having sidewalls, a top closure, and a bottom closure, (b) a tubular liner disposed within said container in flatwise surface engagement with the inside surfaces of said container sidewalls, (c) a wide reinforcing belt having a pair of side edges and a pair of opposite ends, said belt being disposed entirely pheripherally around said liner and secured thereto, said belt extending upward for a distance from substantially the bottom of said liner, and said belt comprising a non-woven backing material to which is adhered a parallel array of yarns extending lengthwise of said belt, said yarns being of a type which exhibits minimal elongation under tension, securing means securing the said belt against relative movement in belt loosening directions and wherein said securing means comprises a patch made of the same material as said belt, said patch having upper and lower side edges and being adhesively secured to said belt with the yarns of the patch and belt being disposed in facing relating and sandwiched between the backing material of said belt and patch.

14. A container as set forth in claim 13 wherein the said opposite ends of said belt are disposed in substantial abutment, and said securing means comprises a patch adhered flatwise to said belt on opposite sides of said abutment.

15. A container as set forth in claim 13 wherein said yarns are spaced closely together in parallel array at the edge of said belt nearest the liner bottom, are relatively widely spaced at the upper edge of said belt, and are continuously graded in spacing density between the two edges of said belt.

16. A container as set forth in claim 13 wherein said belt is substantially one half to two thirds the height of said liner.

17. A container as set forth in claim 13 wherein the width of said patch between its upper and lower side edges is substantially the same as the width of said belt between its side edges.

18. A method of reinforcing corrugated cardboard containers against rupture and excessive deformation by utilization of a substantially non-lengthwise extensible wide fabric belt having a pair of laterally spaced apart side edges and a pair of opposite ends and being of a type comprising a non-woven backing material to one surface of which is adhered a parallel array of yarns extending lengthwise of said belt, said yarns being of a type which exhibits minimal elongation under tension and are spaced closely together in parallel array at one edge of the belt and are relatively widely spaced at the other edge of the belt, and are continuously graded in spacing density between the two edges of the belt, said container being of the type having sidewalls, a top closure and a bottom closure, consisting of the steps of, (a) disposing said fabric belt lengthwise completely peripherally around the carton sidewalls with the edge with the more closely spaced yarns positioned substantially at the bottom of the container sidewalls and the edge with the more widely spaced yarns positioned upward therefrom, and with the backing material disposed flatwise against the surface of the carton sidewalls, (b) adhesively securing the belt backing material to the carton sidewalls in the position aforesaid, (c) securing the opposite ends of the belt against relative movement in belt loosening directions by adhesively securing to the belt a patch made of the same material as the belt with the yarns of the patch and belt being disposed in parallel facing relation and sandwiched between the backing material of said belt and patch.

19. A method of reinforcing corrugated cardboard containers against rupture and excessive deformation by utilization of a substantially non-lengthwise extensible wide fabric belt having a pair of laterally spaced apart side edges and a pair of opposite ends and being of a type comprising a non-woven backing material to one surface of which is adhered a parallel array of yarns extending lengthwise of said belt, said yarns being of a type which exhibits minimal elongation under tension and are spaced closely together in parallel array at one edge of the belt and are relatively widely spaced at the other edge of the belt, and are continuously graded in spacing density between the two edges of the belt, said container being of the type having sidewalls, a top closure, a bottom closure, and a tubular liner disposed within said container in flatwise surface engagement with the inside surfaces of said container sidewalls, consisting of the steps of, (a) disposing said fabric belt lengthwise completely peripherally around the tubular liner with the edge with the more closely spaced yarns positioned substantially at the bottom of the liner and the edge with the more widely spaced yarns positioned upward therefrom, and with the backing material disposed flatwise against the surface of the liner, (b) adhesively securing the belt backing material to the liner in the position aforesaid, (c) securing the opposite ends of the belt against relative movement in belt loosening directions by adhesively securing to the belt a patch made of the same material as the belt with the yarns of the patch and belt being disposed in parallel facing relation and sandwiched between the backing material of said belt and patch, whereby, said liner is ready for installation into said container.

* * * * *